US012064020B2

(12) United States Patent
Hwang et al.

(10) Patent No.: US 12,064,020 B2
(45) Date of Patent: Aug. 20, 2024

(54) REFILLABLE COSMETIC CONTAINER

(71) Applicant: Crystal International (Group) Inc.

(72) Inventors: Roger Hwang, Maple (CA); Stephen M Fisher, II, Sherman, CT (US); William Lloyd Alusitz, Yorktown Heights, NY (US)

(73) Assignee: CRYSTAL INTERNATIONAL (GROUP), Scarborough (CA)

( * ) Notice: Subject to any disclaimer, the term of this patent is extended or adjusted under 35 U.S.C. 154(b) by 533 days.

(21) Appl. No.: 16/884,040

(22) Filed: May 26, 2020

(65) Prior Publication Data

US 2021/0368960 A1 Dec. 2, 2021

(51) Int. Cl.
*A45D 34/00* (2006.01)
*A45D 33/00* (2006.01)
*A45D 40/00* (2006.01)

(52) U.S. Cl.
CPC ..... *A45D 33/003* (2013.01); *A45D 34/00* (2013.01); *A45D 40/00* (2013.01); *A45D 2200/051* (2013.01); *A45D 2200/25* (2013.01)

(58) Field of Classification Search
CPC .. A45D 40/0068; A45D 40/222; A45D 33/18; A45D 2034/005; A45D 2040/225; A45D 2200/05; B65D 15/16; B65D 21/0233; B65D 2251/0018; B65D 2251/0081; B65D 23/0885;

(Continued)

(56) References Cited

U.S. PATENT DOCUMENTS 2,018,271 A * 10/1935 Lewis ..... A24F 19/00 248/362
2,076,550 A * 4/1937 Conner ..... A45D 40/0068 220/62.18

(Continued)

FOREIGN PATENT DOCUMENTS

DE 202019105402 U1 * 2/2021
DE 102019126132 A1 * 4/2021 ..... A45D 40/0068

(Continued)

OTHER PUBLICATIONS

Frech Written Opinion and Search Report for Application No. FR2102706 dated Nov. 23, 2023.

*Primary Examiner* — Chun Hoi Cheung
*Assistant Examiner* — Brijesh V. Patel
(74) *Attorney, Agent, or Firm* — Patterson + Sheridan, LLP

(57) ABSTRACT

A device for dispensing and applying a cosmetic product, the device includes a product dispensing assembly, an applicator which is configured to be coupled within an upper chamber of the product dispensing assembly in a removable manner, and a cap which is configured to be removably engaged with the product dispensing assembly for covering the applicator and the product dispensing assembly when the device is not in use. The applicator comprises an applicator element which is in contact with an intermediate receiving surface of the dispensing head of the product dispensing assembly. At least a portion of the applicator is placed in contact with the product delivered through at least one outlet of the dispensing head when the product dispensing assembly is actuated. Preferably, the product at least partially impregnates the applicator element when the product contacts the applicator element.

22 Claims, 2 Drawing Sheets

(58) Field of Classification Search
CPC ..... B65D 2303/00; B65D 2543/00092; B65D 2543/00296; B65D 2543/00527; B65D 2543/00537; B65D 2543/00546; B65D 2543/00981; B65D 43/0212; B65D 43/0214; B65D 43/0231; B65D 51/18; B65D 77/0493; B65D 83/0094
USPC ..... 206/581, 219; 220/23.87, 23.89, 495.05
See application file for complete search history.

(56) References Cited

U.S. PATENT DOCUMENTS 2,307,648 A * 1/1943 Tremolieres ..... A45D 33/003 206/525
2,728,494 A * 12/1955 Hobson ..... A45D 40/0075 222/386.5
2,753,081 A * 7/1956 Hobson ..... B65D 83/0072 222/482
2,839,209 A * 6/1958 Lester ..... B28B 11/042 264/633
3,244,313 A * 4/1966 Miles ..... B65D 41/0492 215/44
3,347,423 A * 10/1967 Babbin ..... B65D 83/206 222/23
4,240,560 A * 12/1980 Carluccio ..... A45D 40/0068 215/12.1
4,429,798 A * 2/1984 Borows ..... B65D 41/045 215/12.1
4,446,879 A * 5/1984 Gueret ..... A45D 33/00 401/123
4,767,015 A * 8/1988 Ho ..... B29C 66/5344 248/346.11
5,158,193 A * 10/1992 Chen ..... A47G 19/2261 220/729
5,356,025 A * 10/1994 Renault ..... A47G 23/0208 220/737
5,707,698 A * 1/1998 Favre ..... A45D 40/00 428/206
5,860,559 A * 1/1999 Wang ..... A47G 19/2261 220/636
5,938,016 A * 8/1999 Erdtmann ..... A47G 19/2261 220/636
6,520,369 B1 * 2/2003 Cytacki ..... A47G 19/2261 220/636
6,945,419 B2 * 9/2005 Bertazza ..... A45D 40/265 220/23.91
7,104,413 B2 * 9/2006 Liu ..... B65D 43/0231 206/581
7,322,478 B2 * 1/2008 Goto ..... B65D 43/00 206/823
7,451,877 B2 * 11/2008 Koga ..... B65D 43/0231 206/581
D588,916 S * 3/2009 DeMarco ..... A45D 33/16 D9/504
D621,261 S * 8/2010 DeMarco ..... A47G 19/02 220/573.1
7,784,638 B2 * 8/2010 Kishbaugh ..... A47G 19/02 220/573.1
8,714,403 B2 * 5/2014 Amprimo ..... A47G 19/2261 220/729
8,820,521 B2 * 9/2014 Hodgson ..... A24F 23/00 206/265
8,870,011 B2 * 10/2014 Hammer ..... B65D 21/0233 206/581
9,452,873 B2 * 9/2016 Eberlein ..... A45D 33/006
9,604,739 B2 * 3/2017 Bouix ..... A45D 33/006
10,737,841 B1 * 8/2020 Duong ..... A45D 33/18
10,829,271 B1 * 11/2020 Bulla ..... B65D 43/0231
2003/0071040 A1 * 4/2003 Brodner ..... B65D 25/205 220/23.87
2005/0258126 A1 * 11/2005 Canamasas Puigbo ..... B65D 81/3841 215/10
2009/0188518 A1 * 7/2009 Thorpe ..... A47G 19/02 220/573.1
2015/0230583 A1 8/2015 Maelstaf et al.
2016/0235184 A1 * 8/2016 Lee ..... B65D 51/18
2017/0065054 A1 * 3/2017 Hori ..... A45D 34/00
2018/0020804 A1 * 1/2018 Pires ..... A45D 33/025 132/293
2019/0037999 A1 * 2/2019 Mecca ..... B65D 83/06
2019/0307292 A1 * 10/2019 Haas ..... A47J 41/0088
2020/0071047 A1 * 3/2020 Chen ..... B65D 77/0493

FOREIGN PATENT DOCUMENTS

EP 0590442 A1 * 4/1994 ..... A45D 40/0068
EP 1609385 A1 12/2005
FR 2602128 A1 * 2/1988 ..... A45D 40/0075
FR 2741042 A1 * 5/1997 ..... A45D 40/0068
FR 2745276 A 8/1997
FR 3060271 A1 6/2018
FR 3071388 A1 3/2019
FR 3109283 A1 * 10/2021
JP 2015030459 A * 2/2015
KR 20150001855 U * 5/2015 ..... A45D 40/0068
KR 20180012042 A 2/2018
TW M365672 U 10/2009
WO WO-2007045474 A1 * 4/2007 ..... A47D 40/0068
WO WO-2019058087 A1 * 3/2019 ..... A45D 33/003

* cited by examiner

REFILLABLE COSMETIC CONTAINER

BACKGROUND

Field of the Invention

The present disclosure relates to a refillable cosmetic container for a cosmetic product that comprises a removable inner container intended to be implemented in such a refillable cosmetic container.

Description of the Related Art

In the cosmetic field, in particular, users are particularly sensitive to the aesthetics of packaging devices. However, the cost of cosmetic packaging devices is high and increases the price of cosmetics sold in this form commercially.

Wide-mouth containers called "jars" are widely used as containers for storing cosmetics that are fluid but relatively viscous, such as moisturizing creams, massage creams, and foundations. Such a wide-mouthed container is usually a relatively thick one for protecting the contents, and is often provided with a luxurious decoration with a high-class appearance. For this reason, it is not economical and not preferable from the standpoint of environmental conservation to discard the entire contents when the contents are empty. Therefore, recently, the contents can be stored in a replaceable refill container (simple inner container) and detachably stored in a wide-mouth container that is an outer container. When the contents are empty, only the refill container is discarded.

An idea has emerged to provide an aesthetic cosmetic container, including a separate inner container, less aesthetic, but whose packaging is cheaper. Preferably, the inner container is removable so as to recharge the cosmetic container, by replacing the removable inner container.

An object of the present disclosure is to provide a refillable cosmetic container. In particular, the disclosure aims to provide a refillable cosmetic container whose inner container can easily be replaced, while ensuring a satisfactory attachment of the removable inner container, especially when the lid of the cosmetic container is closed.

SUMMARY

Accordingly there is provided a refillable cosmetic container comprising a removable inner container configured to house a cosmetic product, an outer container configured to receive the removable inner container, a lid and a seal. The seal is intended to prevent the cosmetic product contained in the removable inner container from drying out.

According to an aspect of the present disclosure, the removable inner container may in particular comprise cosmetic product in the form of cream, paste, powder, gel, liquid or solid monoblock.

More specifically, the outer container defines a housing intended to receive the removable inner container. The housing of the outer container is a cavity that opens out at a first opening at an upper end of the outer container and a second opening at a bottom wall of the outer container. The second opening at the bottom wall of the outer container advantageously allows the passage of a finger or a thumb of a user. The outer container forms an upper edge around the first opening. Further, the lid is shaped so to be able to close the first opening of the housing of the outer container.

According to yet another aspect of the present disclosure, the outer container includes at least one sidewall that extends between the upper edge of the first opening to the bottom wall of the outer container. The at least one sidewall further comprises a lower portion and an upper portion. The at least one sidewall further comprises a first step and the second step and wherein the first step is formed between the lower portion and the upper portion, and the second step is formed in the upper portion of the at least one sidewall of the outer container. Thus, the upper portion is stepped in from the lower portion of the at least one sidewall of the outer container. Further, a gap exists between an outer surface of at least a part of the upper portion of the at least one side wall of the outer container and an inner surface of at least a part of the side wall of the lid when the lid is fixed on the outer container.

According to yet another aspect of the present disclosure, the lid comprises a top wall and a sidewall extending downwardly therefrom. The sidewall can take any desired shape, especially in order to obtain an aesthetic effect.

When the lid is placed on the outer container, a bottom edge of the sidewall of the lid abut/rests on the first step of the at least one sidewall of the outer container.

According to yet another aspect of the present disclosure, the upper portion of the at least one sidewall of the outer container includes features to removably engage with the lid. More particularly, an outer surface of the upper portion of the at least one sidewall of the outer container is provided with threads for engaging with corresponding threads formed on an inner surface of the sidewall of the lid, to fix the lid on the outer container.

According to yet another aspect of the present disclosure, a proximal end portion of the sidewall of the lid at the inner surface has threads thereon and an outer surface of a proximal end portion of the at least one sidewall of the outer container has corresponding threads thereon However, in alternative embodiments, the threads may be located anywhere at the inner surface of the sidewall of the lid and the threads may be located anywhere at an outer surface of the at least one sidewall of the outer container.

According to yet another aspect of the present disclosure, a length of the upper portion of the at least one sidewall corresponds to at least 50% of a length of the at least one sidewall of the outer container. In other words, the upper portion defines 50 percent or more than 50 percent of the length of the at least one sidewall of the outer container. According to yet another aspect of the present disclosure, a length of the upper portion of the at least one sidewall is in a range of 50% to 70% of a length of the at least one sidewall of the outer container. Preferably, a length of the upper portion of the at least one sidewall corresponds to substantially 60% of a length of the at least one sidewall of the outer container.

According to yet another aspect of the present disclosure, the lid covers the upper portion of the at least one sidewall of the outer container by its sidewall and has a length substantially equal to the length of the upper portion of the at least one sidewall of the outer container. Thus, the sidewall covers at least 50% to 70% of the length of the at least one sidewall of the outer container, covering the upper portion while the lower portion of the at least one sidewall of the outer container is not covered and is visible to the user.

According to yet another aspect of the present disclosure, the removable inner container comprises a bottom wall and a sidewall defining a cavity configured to house a cosmetic product therein. A flange is formed at a proximal end of the sidewall of the removable inner container, and wherein the flange surrounds an opening of the cavity. The bottom wall of the removable inner container is substantially flat. Moreover, the side wall of the removable inner container has a substantially cylindrical shape. The side wall has an upper portion and a lower portion. The upper portion extends parallel to a central longitudinal axis of the removable inner container and the lower portion is curved. Further, an outer surface of the upper portion of the sidewall of the removable inner container corresponds to an inner surface of the upper portion of the at least one sidewall of the outer container and an outer surface of the lower portion of the sidewall of the removable inner container corresponds to an inner surface of the lower portion of the at least one sidewall of the outer container such that there is no gap between the outer surface of the side wall of the removable inner container and the inner surface of the at least one side wall of the outer container when the removable inner container is engaged into the outer container.

Further, an outer surface of the sidewall of the removable inner container corresponds to an inner surface of the at least one sidewall of the outer container such that there is no gap between the outer surface of the side wall of the removable inner container and the inner surface of the at least one side wall of the outer container when the removable inner container is engaged into the outer container.

Alternatively, other forms of the side wall of the removable inner container are conceivable. However, the curved lower portion of the side wall of the removable inner container facilitates access by the user to the entire cosmetic product contained in the removable inner container.

According to yet another aspect of the present disclosure, an inner surface of the at least one sidewall of the outer container comprises a step at the proximal end portion of the outer container. Further, the inner surface of the sidewall of the outer container also comprises an annular groove. The removable inner container includes an annular protrusion on the outer surface of the sidewall of the removable inner container that snap fits into corresponding annular groove of the outer container such that on snapping, the flange of the inner container rests on the step of the outer container. Further, an upper surface of the upper edge of the outer container and an upper surface of the flange of the inner container flush when the inner container is received and snap fitted into the outer container.

Preferably, the lid comprises a seal provided on an inner surface of the top wall of the lid. In particular, when the lid is fixed on the outer container, the seal is clamped between the inner surface of the top wall of the lid and the upper edge of the outer container. Also, when the lid is fixed on the outer container, the seal is also clamped between the inner surface of the top wall of the lid and the flange of the removable inner container, in particular the top of the flange of the removable inner container.

The outer container is here shaped to allow the outer container to be placed in equilibrium on a flat support. This illustrated the outer container rests on such a plane and has an annular recess in the bottom wall surrounding the second opening of the outer container. The annular recess in the bottom wall houses an annular ring therein, and wherein an outer surface of the annular ring, the outer surface of the bottom wall of the removable inner container and the outer surface of the bottom wall of the outer container are contiguous or flush with each other providing a substantially contiguous flat bottom surface of the refillable cosmetic container.

According to a preferred embodiment, the annular recess in the bottom wall houses an elastomeric annular ring therein, and wherein the elastomeric ring provides a cushioning effect and dampens the noise when the outer container is placed on a plane surface.

The refillable cosmetic container can be sold fully assembled. Alternatively, the refillable cosmetic container can be sold as a kit. In this case, the mounting of such a refillable cosmetic container can be carried out as follows.

Firstly, the removable inner container is inserted partially into the housing formed by the outer container and then, the removable inner container is pushed towards the outer container so that the annular protrusion of the removable inner container snap fits into corresponding annular groove of the outer container. Finally, the lid is screwed onto the outer container.

The removable inner container may be provided with a sealed lid. This sealed lid can be removed from the removable inner container before or after insertion into the outer container. The sealed lid, optionally provided with a seal, seals the removable inner container before opening.

Once the entire content of the removable inner container is used, the user can remove the removable inner container of the refillable cosmetic container. To remove the removable inner container, a user must first remove the lid. Then only the user can remove the removable inner container. The removal of the removable inner container out of the outer container may for example be made by pushing on the removable inner container through the second opening in the bottom of the outer container.

Once the old removable inner container is removed, the user can then insert a new removable inner container, operating as described above.

In this embodiment, it is possible to make the sidewall of the removable inner container of any desired shape, adapted to the housing of the outer container.

Moreover, the side walls of the outer container and the removable inner container may in particular be of substantially hemi-ellipsoidal shape or even of polyhedral shape.

The lid can be removably fixed to the outer container by screwing, as in the example described above or, alternatively, by snap fitment, by elastic fitting, by clamping, by magnetization, by means of a bayonet attachment or by any other means accessible to the user skilled in the art.

The removable inner container can be removably fixed to the outer container by snap fitment, as in the example described above or, alternatively, by screwing, by elastic fitting, by clamping, by magnetization, by means of a bayonet attachment or by any other means accessible to the user skilled in the art.

The outer container may in particular be made of one of: glass, metal, ceramic, porcelain, crystal and plastic, especially polymethyl methacrylate, polystyrene, polycarbonate, polyethylene terephthalate, ionomer resin such as the ethylene vinyl copolymer known as trade name of Surlyn®, natural stone, synthetic stone, ceramics, porcelain, wood and urea formaldehyde.

The outer container may be translucent, or even transparent. This gives the outer container and the refillable cosmetic container an aesthetic effect appreciated by the users. The outer container may also be opaque.

The lid may be translucent, even transparent, or opaque otherwise. The lid is for example made of one of wood, a ceramic material, metal, porcelain, a rigid foam for example polyurethane type, natural stone, synthetic stone, mixed stone powder to a binder, converted by injection, leather, glass, crystal, plastic including sand thermoset plastic, such as formalin urea, or thermoplastic plastic, and/or especially frosted and/or varnished plastic and/or painted and/or metallized and/or galvanized and/or provided with visual effects, natural fabric, or synthetic fabric, or any other known material for making a lid.

The removable inner container may especially be made of aluminum, aluminum alloy, steel, glass, plastic, ceramic, porcelain, cardboard, especially coated cardboard or multi-layer cardboard complexed with other materials such as metal sheets or plastic sheets. Depending on the materials used, the realization of the removable inner container is more or less easy and therefore expensive. More noble materials such as porcelain, ceramic or glass, can be chosen to ensure an aesthetic effect. The use of these materials can also contribute to the aesthetic effect of the refillable cosmetic container, especially when the outer container is translucent or transparent.

The above summary provides a basic understanding of the aspects of the disclosure. This summary is not an extensive overview of all contemplated aspects, and is not intended to identify all key or critical elements or to delineate the scope of any or all aspects.

The above and other objects, features and advantages of the present disclosure will become clear from the following description of the preferred embodiments when the same is read in conjunction with the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings.

Figure 1:
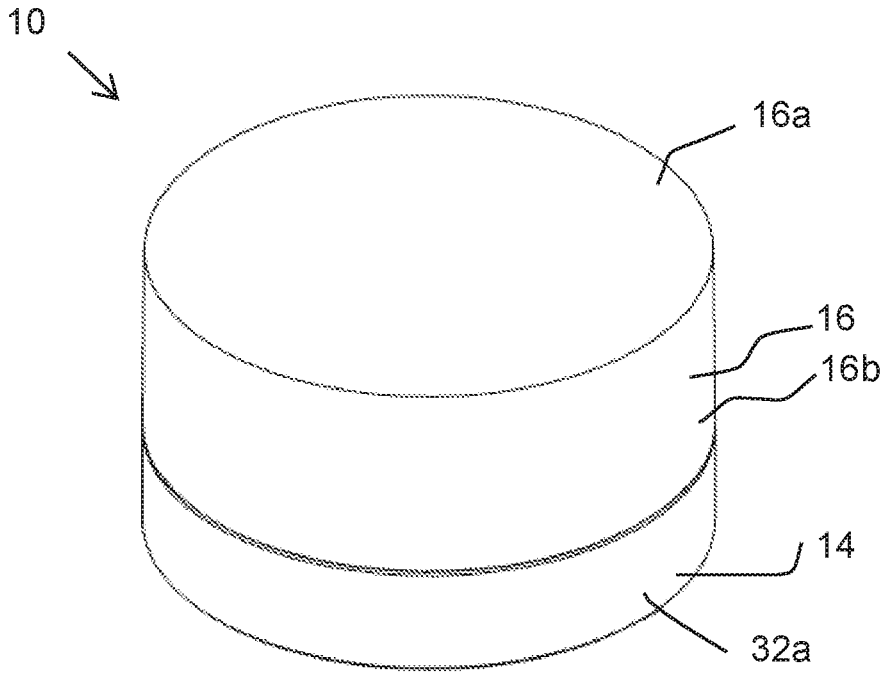
FIG. 1 illustrates a perspective view of a refillable cosmetic container in a closed state, according to an embodiment of the present disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 2:
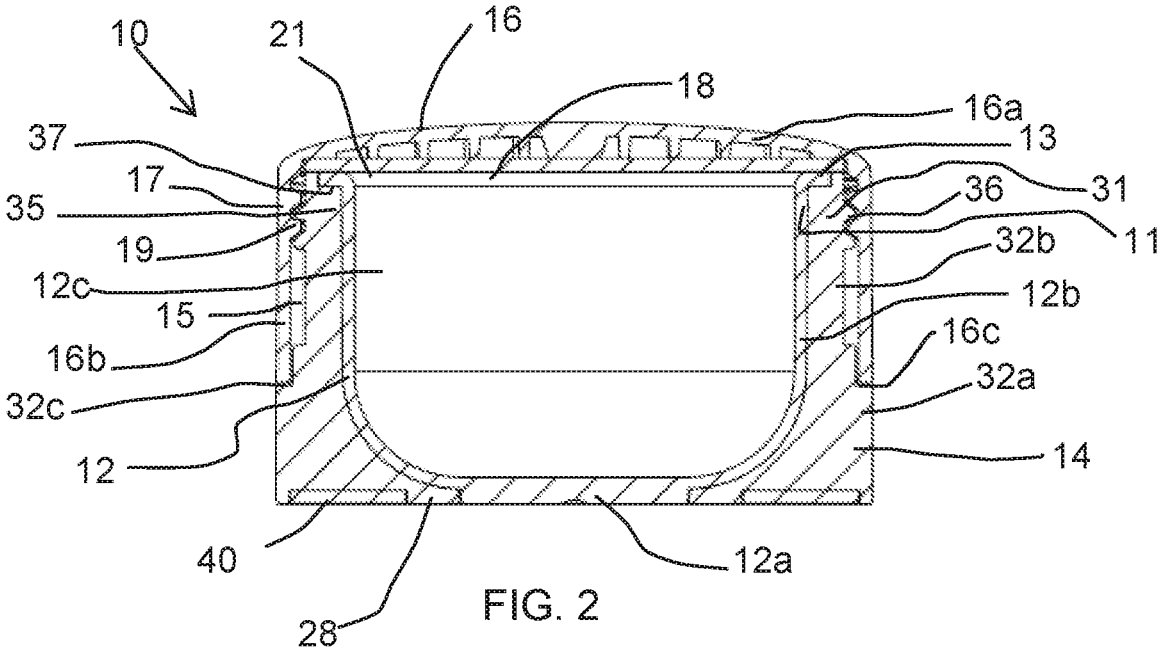
FIG. 2 illustrates a longitudinal sectional view of the refillable cosmetic container of FIG. 1.
Figure 3:
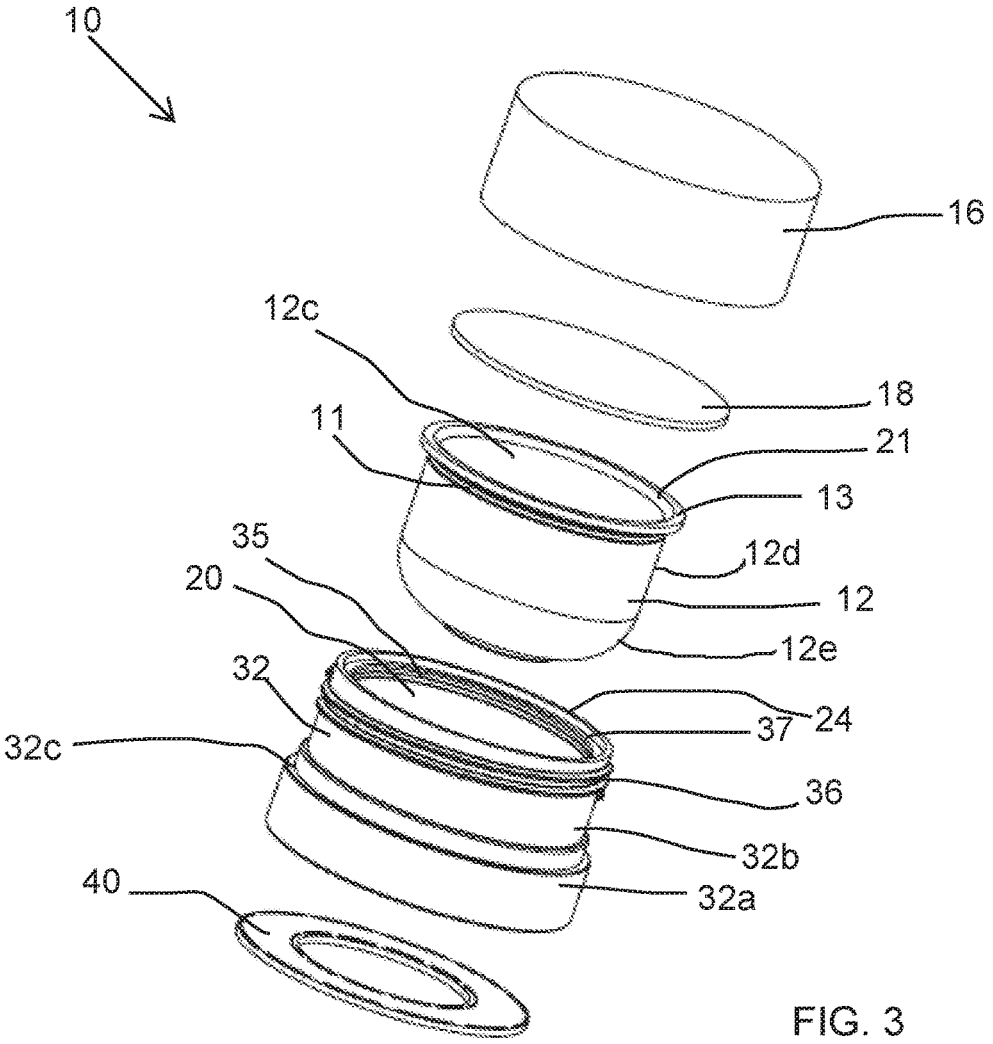
FIG. 3 represents an exploded view of the refillable cosmetic container of FIG. 1.

FIGS. 1 to 3 illustrate a refillable cosmetic container 10 according to the present disclosure. The refillable cosmetic container 10 comprises a removable inner container 12 configured to house a cosmetic product, an outer container 14 configured to receive the removable inner container 12, a lid 16 and a seal 18. The seal 18 is intended to prevent the cosmetic product contained in the removable inner container 12 from drying out.

The removable inner container 12 may in particular comprise cosmetic product in the form of cream, paste, powder, gel, liquid or solid monoblock.

Figure 4:
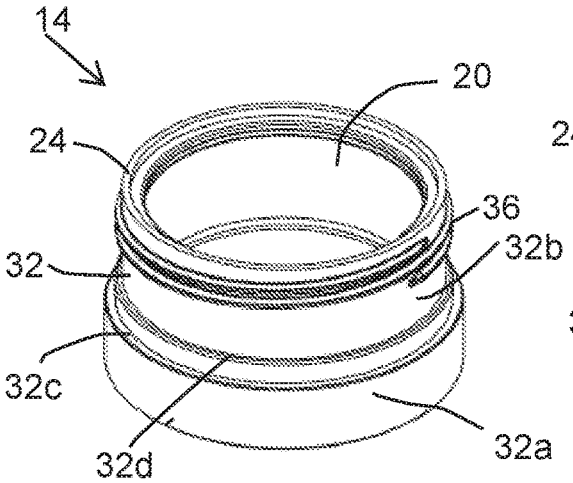
FIG. 4 illustrates a perspective view of an outer container of the refillable cosmetic container of FIG. 1.
Figure 5:
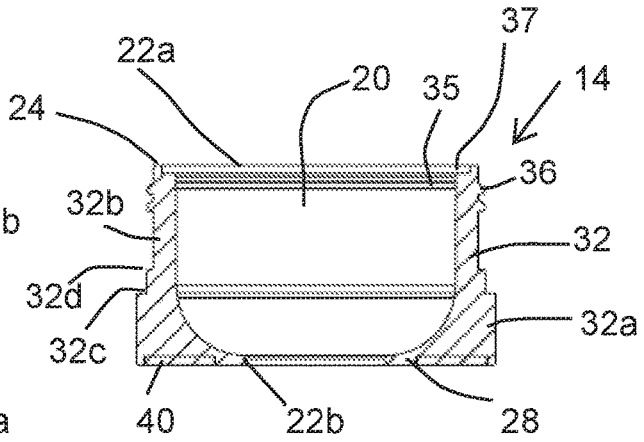
FIG. 5 illustrates a longitudinal sectional of the outer container of FIG. 4.

More specifically, as shown in FIGS. 3-5, the outer container 14 defines a housing 20 intended to receive the removable inner container 12. The housing 20 of the outer container 14 is a cavity that opens out at a first opening 22*a* at an upper end of the outer container 14 and a second opening 22*b* at a bottom wall 28 of the outer container 14. The second opening 22*b* at the bottom wall 28 of the outer container 14 advantageously allows the passage of a finger or a thumb of a user to remove the inner removable container 12 from the outer container 14. The outer container 14 forms an upper edge 24 around the first opening 22*a*. Further, the lid 16 is shaped so to be able to close the first opening 22*a* of the housing 20 of the outer container 14, shown in FIG. 2.

Further, the outer container 14 includes at least one sidewall 32 that extends between the upper edge 24 of the first opening 22*a* to the bottom wall 28 of the outer container 14. The at least one sidewall 32 further comprises a lower portion 32*a* and an upper portion 32*b*. The at least one sidewall 32 further comprises a first step 32*c* and the second step 32*d* and wherein the first step 32*c* is formed between the lower portion 32*a* and the upper portion 32*b*, and the second step 32*d* is formed in the upper portion 32*b* of the at least one sidewall 32 of the outer container 14. Thus, the upper portion 32*b* is stepped in from the lower portion 32*a* of the at least one sidewall 32. Further, a gap 15 exists between an outer surface of at least a part of the upper portion 32*b* of the at least one side wall 32 of the outer container 14 and an inner surface of at least a part of the side wall 16*b* of the lid 16 when the lid 16 is fixed on the outer container.

Further, the lid 16 comprises a top wall 16*a* and the sidewall 16*b* extending downwardly therefrom. The sidewall 16*b* can take any desired shape, especially in order to obtain an aesthetic effect.

When the lid 16 is placed on the outer container 14, a bottom edge 16*c* of the sidewall 16*b* of the lid 16 abut/rests on the first step 32*c* of the at least one sidewall 32 of the outer container 14, as shown in FIG. 2.

Further, as shown in FIGS. 2-5, the upper portion 32*b* of the at least one sidewall 32 of the outer container 14 includes features to removably engage with the lid 16. More particularly, an outer surface of the upper portion 32*b* of the at least one sidewall 32 is provided with threads 36 for engaging with corresponding threads 19 formed on an inner surface of the sidewall 16*b* of the lid 16, to fix the lid 16 on the outer container 14.

Referring to FIG. 2, the threads 19 are located at a proximal end portion 17 of the sidewall 16*b* at the inner surface thereof and the threads 36 are located at an outer surface of a proximal end portion 31 of the at least one sidewall 32 of the outer container 14. However, in alternative embodiments, the threads 19 may be located anywhere at the inner surface of the sidewall 16*b* of the lid 16 and the threads 36 may be located anywhere at the outer surface of the at least one sidewall 32 of the outer container 14.

As seen in FIGS. 2-5, a length of the upper portion 32*b* of the at least one sidewall 32 corresponds to at least 50% of a length of the at least one sidewall 32 of the outer container 14. In other words, the upper portion 32*b* defines 50 percent or more than 50 percent of the length of the at least one sidewall 32 of the outer container 14. According to yet another aspect of the present disclosure, a length of the upper portion 32*b* of the at least one sidewall 32 is in a range of at least 50% to 70% of a length of the at least one sidewall 32 of the outer container 14. Preferably as shown in present embodiment in FIGS. 2-5, a length of the upper portion 32*b* of the at least one sidewall 32 corresponds to substantially 60% of a length of the at least one sidewall 32 of the outer container 14.

Further, as shown in FIGS. 1-2, the lid 16 covers the upper portion 32*b* of the at least one sidewall 32 by its sidewall 16*b* and has a length substantially equal to the length of the upper portion 32*b* of the at least one sidewall 32 of the outer container 14. Thus, the sidewall 16*b* covers at least at least 50% to 70%, preferably substantially 60% of the length of the at least one sidewall 32 of the outer container 14, covering the upper portion 32*b* while the lower portion 32*a* of the at least one sidewall 32 of the outer container 14 is not covered and is visible to a user.

As shown in FIGS. 2 and 3, the removable inner container 12 comprises a bottom wall 12*a* and a sidewall 12*b* defining a cavity 12*c* configured to house a cosmetic product therein. A flange 13 is formed at a proximal end of the sidewall 12*b* of the removable inner container 12, and wherein the flange 13 surrounds an opening 21 of the cavity 12*c*. The bottom wall 12*a* of the removable inner container 12 is substantially flat. Moreover, the side wall 12*b* of the removable inner container 12 has a substantially cylindrical shape. The side wall 12*b* has an upper portion 12*d* and a lower portion 12*e*. The upper portion 12*b* extends parallel to a central longitudinal axis of the removable inner container 12 and the lower portion 12*e* is curved. Further, an outer surface of the upper portion 12*b* corresponds to an inner surface of the upper portion 32*b* of the at least one sidewall 32 of the outer container 14 and an outer surface of the lower portion 12*e* corresponds to an inner surface of the lower portion 32*a* of the at least one sidewall 32 of the outer container 14 such that there is no gap between the outer surface of the side wall 12*b* of the removable inner container 12 and the inner surface of the at least one side wall 32 of the outer container 14 when the removable inner container 12 is engaged into the outer container 14. Further, an outer surface of the sidewall 12*b* of the removable inner container 12 corresponds to an inner surface of the at least one sidewall 32 of the outer container 14 such that there is no gap between the outer surface of the side wall 12*b* of the removable inner container 12 and the inner surface of the at least one side wall 32 of the outer container 14 when the removable inner container 12 is engaged into the outer container 14.

Alternatively, other forms of the side wall 12*b* of the removable inner container 12 are conceivable. However, the curved lower portion of the side wall 12*b* of the removable inner container 12 facilitates access by the user to the entire cosmetic product contained in the removable inner container 12.

Further, an outer surface of the bottom wall 12*a* of the removable inner container 12 is contiguous or flush with at least a portion of an outer surface of the bottom wall 28 of the outer container 14.

Referring to FIG. 2 and FIG. 5, an inner surface of the sidewall 32 of the outer container 14 comprises a step 37 at the proximal end portion of the outer container 14. Further, the inner surface of the sidewall 32 of the outer container 14 also comprises an annular groove 35. As shown in FIGS. 2 and 3, the removable inner container 12 includes an annular protrusion 11 on the outer surface of the sidewall 12*b* of the removable inner container 12 that snap fits into corresponding annular groove 35 of the outer container 14 such that on snapping, the flange 13 of the inner container 12 rests on the step 37 of the outer container 14. Further, an upper surface of the upper edge 24 of the outer container 14 and an upper surface of the flange 13 of the inner container 12 flush when the inner container 12 is received and snap fitted into the outer container 14.

Preferably, the lid 16 comprises a seal 18 provided on an inner surface of the top wall 16*a* of the lid. In particular, as is for example visible in FIG. 2, when the lid 16 is fixed on the outer container 14, the seal 18 is clamped between the inner surface of the top wall 16*a* of the lid 16 and the upper edge 24 (see FIG. 5) of the outer container 14. Also, when the lid 16 is fixed on the outer container 14, the seal 18 is also clamped between the inner surface of the top wall 16*a* of the lid 16 and the flange 13 of the removable inner container 12, in particular the top of the flange 13 of the removable inner container 12.

As seen in FIG. 2, the outer container 14 is here shaped to allow the outer container 14 to be placed in equilibrium on a flat support. This illustrated the outer container 14 rests on such a plane and has an annular recess in the bottom wall 28 surrounding the second opening 22*b* of the outer container 14. The annular recess in the bottom wall 28 houses an annular ring 40 therein, and wherein an outer surface of the annular ring 40, the outer surface of the bottom wall 12*a* of the removable inner container 12 and the outer surface of the bottom wall 28 of the outer container 14 are contiguous or flush with each other providing a substantially contiguous flat bottom surface of the refillable cosmetic container 10.

According to a preferred embodiment, the annular recess in the bottom wall 28 houses an elastomeric annular ring 40 therein, and wherein the elastomeric ring 40 provides a cushioning effect and dampens the noise when the outer container 14 is placed on a plane surface.

The refillable cosmetic container 10 can be sold fully assembled. Alternatively, the refillable cosmetic container 10 can be sold as a kit. In this case, the mounting of such a refillable cosmetic container 10 can be carried out as follows.

Firstly, the removable inner container 12 is inserted partially from the first opening 22*a* into the housing 20 formed by the outer container 14 and then, the removable inner container 12 is pushed towards the outer container 14 so that the annular protrusion 11 of the removable inner container 12 snap fits into the corresponding annular groove 35 of the outer container 14. Finally, the lid 16 is screwed onto the outer container 14.

The removable inner container 12 may be provided with a sealed lid. This sealed lid can be removed from the removable inner container 12 before or after insertion into the outer container 14. The sealed lid, optionally provided with a seal, seals the removable inner container 12 before opening.

Once the entire content of the removable inner container 12 is used, the user can remove the removable inner container 12 of the refillable cosmetic container 10. To remove the removable inner container 12, a user must first remove the lid 16. Then only the user can remove the removable inner container 12. The removal of the removable inner container 12 out of the outer container 14 may for example be made by applying a push force on the bottom wall 12*a* of the removable inner container 12 through the second opening 22*b* in the bottom wall 28 of the outer container 14.

Once the old removable inner container 12 is removed, the user can then insert a new removable inner container 12, operating as described above.

In this embodiment, it is possible to make the sidewall 12*b* of the removable inner container 12 of any desired shape, adapted to the housing 20 in the outer container 14.

Moreover, the side walls of the outer container 14 and the removable inner container 12 may in particular be of substantially hemi-ellipsoidal shape or even of polyhedral shape.

The lid 16 can be removably fixed to the outer container 14 by screwing, as in the example described above or, alternatively, by elastic fitting, by clamping, by snap fitment, by magnetization, by means of a bayonet attachment or by any other means accessible to the user skilled in the art.

The removable inner container 12 can be removably fixed to the outer container 14 by snap fitment, as in the example described above or, alternatively, by screwing, by elastic fitting, by clamping, by magnetization, by means of a bayonet attachment or by any other means accessible to the user skilled in the art.

The outer container 14 may in particular be made of one of: glass, metal, ceramic, porcelain, crystal and plastic, especially polymethyl methacrylate, polystyrene, polycarbonate, polyethylene terephthalate, ionomer resin such as the ethylene vinyl copolymer known as trade name of Surlyn®, natural stone, synthetic stone, ceramics, porcelain, wood and urea formaldehyde.

The outer container 14 may be translucent, or even transparent. This gives the outer container 14 and the refillable cosmetic container 10 an aesthetic effect appreciated by the users. The outer container 14 may also be opaque.

The lid 16 may be translucent, even transparent, or opaque otherwise. The lid 16 is for example made of one of wood, a ceramic material, metal, porcelain, a rigid foam for example polyurethane type, natural stone, synthetic stone, mixed stone powder to a binder, converted by injection, leather, glass, crystal, plastic including sand thermoset plastic, such as formalin urea, or thermoplastic plastic, and/or especially frosted and/or varnished plastic and/or painted and/or metallized and/or galvanized and/or provided with visual effects, natural fabric, or synthetic fabric, or any other known material for making a lid.

The removable inner container 12 may especially be made of aluminum, aluminum alloy, steel, glass, plastic, ceramic, porcelain, cardboard, especially coated cardboard or multilayer cardboard complexed with other materials such as metal sheets or plastic sheets. Depending on the materials used, the realization of the removable inner container is more or less easy and therefore expensive. More noble materials such as porcelain, ceramic or glass, can be chosen to ensure an aesthetic effect and quality appreciated and sought after by users. The use of these materials can also contribute to the aesthetic effect of the refillable cosmetic container 10, especially when the outer container 14 is translucent or transparent.

The disclosure is not limited to the embodiments described above with reference to the FIGS, but is, on the contrary, capable of many variants accessible to those skilled in the art. In particular, the characteristics of the various embodiments described can be combined in embodiments not illustrated in the FIGS.

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variations that fall within the scope of the appended claims.

What is claimed is:

1. A refillable cosmetic container comprising:

a removable inner container configured to house a cosmetic product;

an outer container configured to receive the removable inner container;

a lid removably engaged with the outer container;

a seal to prevent the cosmetic product contained in the removable inner container from drying out;

wherein the outer container includes a sidewall and a bottom wall extending inward from the sidewall, the outer container having a first opening at an upper end of the sidewall larger than a second opening in the bottom wall of the outer container;

wherein the removable inner container is received within the sidewall of the outer container;

wherein the removable inner container has a solid bottom wall which extends into the second opening in the bottom wall of the outer container;

wherein the outer container has an annular recess disposed in and circumscribed by an outer portion of the bottom wall of the outer container, the annular recess circumscribing both an inner portion of the bottom wall and the second opening of the outer container, wherein the outer container has an upper edge around the first opening and the sidewall extends between the upper edge of the first opening to the bottom wall of the outer container;

wherein the sidewall of the outer container includes a lower portion and an upper portion, wherein the lid comprises a top wall and a sidewall extending downwardly from the top wall, wherein the upper portion of the sidewall of the outer container extends at least 50% of a length of the sidewall of the outer container and wherein the sidewall of the lid covers the upper portion of the sidewall of the outer container; and wherein the sidewall of the lid has a length about equal to the length of the upper portion of the sidewall of the outer container.

2. The refillable cosmetic container of claim 1, wherein an outer surface of the upper portion of the sidewall of the outer container is provided with threads for engaging with corresponding threads formed on an inner surface of the sidewall of the lid.

3. The refillable cosmetic container of claim 1, wherein the removable inner container includes an annular protrusion on an outer surface of a sidewall of the removable inner container that snap fits into a corresponding annular groove present on an inner surface of the sidewall of the outer container present.

4. The refillable cosmetic container of claim 1, wherein the lid and the removable inner container are removably engaged to the outer container by screwing, by elastic fitting, by clamping, by snap fitment, by magnetization or a bayonet attachment.

5. The refillable cosmetic container of claim 1, wherein the removable inner container comprise cosmetic product in the form selected from a group consisting of cream, paste, powder, gel, liquid and a solid monoblock.

6. The refillable cosmetic container of claim 1, wherein the upper portion of the sidewall of the outer container extends at least 50% to 70% of the length of the sidewall of the outer container.

7. The refillable cosmetic container of claim 1, wherein a first step exists between the lower portion and the upper portion of the sidewall of the outer container, and wherein when the lid is placed on the outer container a bottom edge of the sidewall of the lid rests on the first step of the sidewall of the outer container.

8. The refillable cosmetic container of claim 1, wherein a second step is formed in the upper portion of the sidewall of the outer container and wherein the upper portion of the sidewall of the outer container is stepped in from the lower portion of the sidewall of the outer container in forming a gap between the outer container and the lid.

9. The refillable cosmetic container of claim 1, wherein a gap exists between an outer surface of at least a part of the upper portion of the sidewall of the outer container and an inner surface of at least a part of the upper portion of the sidewall of the lid when the lid is fixed on the outer container.

10. The refillable cosmetic container of claim 1, wherein when the lid is fixed on the outer container, the seal is clamped between an inner surface of the top wall of the lid and the upper edge of the outer container.

11. The refillable cosmetic container of claim 1, wherein the second opening at the bottom wall of the outer container allows the passage of a finger or a thumb of a user to remove the removable inner container from the outer container.

12. The refillable cosmetic container of claim 1, wherein the annular recess in the bottom wall houses an annular ring therein.

13. The refillable cosmetic container of claim 12, wherein an outer surface of the annular ring, an outer surface of the solid lowermost wall of the removable inner container and an outer surface of the bottom wall of the outer container are contiguous or flush with each other providing a substantially contiguous flat bottom surface of the refillable cosmetic container.

14. The refillable cosmetic container of claim 1, wherein an outer surface of the solid lowermost wall of the removable inner container and an outer surface of the bottom wall of the outer container are contiguous or flush with each other providing a substantially contiguous flat bottom surface of the refillable cosmetic container.

15. A refillable cosmetic container comprising:

a removable inner container configured to house a cosmetic product;

an outer container configured to receive the removable inner container;

a lid removably engaged with the outer container;

wherein the outer container includes a housing having a first opening at an upper end of the outer container larger than a second opening at a bottom wall of the outer container;

wherein the outer container has an annular recess disposed in and circumscribed by an outer portion of the bottom wall of the outer container, the annular recess circumscribing both an inner portion of the bottom wall and the second opening of the outer container, wherein the outer container has an upper edge around the first opening and includes at least one sidewall that extends between the upper edge of the first opening to the bottom wall of the outer container;

wherein the removable inner container is received in the housing of the outer container;

wherein the removable inner container comprises a solid lowermost wall and a sidewall defining a cavity configured to house the cosmetic product therein and wherein a ring shaped flange is formed at a proximal end of the sidewall of the removable inner container such that the ring shaped flange surrounds an opening of the cavity, wherein the solid lowermost wall extends into the second opening at the bottom wall of the outer container; and wherein when the removable inner container is received into the outer container, the ring shaped flange of the removable inner container rests on a step formed at an inner surface of the proximal end portion of at least one the sidewall of the outer container.

16. The refillable cosmetic container of claim 15, wherein upper surfaces of the upper edge of the outer container and the ring shaped flange of the removable inner container flush when the removable inner container is engaged into the outer container.

17. The refillable cosmetic container of claim 15, wherein an outer surface of the sidewall of the removable inner container corresponds to an inner surface of the at least one sidewall of the outer container such that there is no gap between the outer surface of the sidewall of the removable inner container and the inner surface of the at least one sidewall of the outer container when the removable inner container is engaged into the outer container.

18. The refillable cosmetic container of claim 15, wherein the sidewall of the removable inner container has an upper portion and a lower portion, wherein the upper portion extends parallel to a central longitudinal axis of the removable inner container and the lower portion is curved.

19. The refillable cosmetic container of claim 18, wherein an outer surface of the upper portion of the sidewall of the removable inner container corresponds to an inner surface of the upper portion of at least one the sidewall of the outer container and an outer surface of the lower portion of the sidewall of the removable inner container corresponds to an inner surface of the lower portion of at least one the sidewall of the outer container such that there is no gap between the outer surface of the sidewall of the removable inner container and the inner surface of at least one the sidewall of the outer container when the removable inner container is engaged into the outer container.

20. The refillable cosmetic container of claim 15, wherein an outer surface of the solid lowermost wall of the removable inner container is contiguous or flush with at least a portion of an outer surface of the bottom wall of the outer container.

21. The refillable cosmetic container of claim 15, wherein the annular recess in the bottom wall houses an annular ring therein.

22. The refillable cosmetic container of claim 21, wherein an outer surface of the annular ring, an outer surface of a bottom wall of the removable inner container and an outer surface of the bottom wall of the outer container are contiguous or flush with each other providing a substantially contiguous flat bottom surface of the refillable cosmetic container.

* * * * *